US011006739B2

(12) United States Patent
Sze

(10) Patent No.: US 11,006,739 B2
(45) Date of Patent: May 18, 2021

(54) HAIR BRUSHES AND METHODS OF MANUFACTURE THEREOF

(71) Applicant: TUNG HING PLASTIC MANUFACTORY LTD., Kowloon (HK)

(72) Inventor: Ka Chuen Sze, Kowloon (HK)

(73) Assignee: TUNG HING PLASTIC MANUFACTORY LTD., Kowloon (HK)

( * ) Notice: Subject to any disclaimer, the term of this patent is extended or adjusted under 35 U.S.C. 154(b) by 206 days.

(21) Appl. No.: 16/256,173

(22) Filed: Jan. 24, 2019

(65) Prior Publication Data

US 2019/0231059 A1 Aug. 1, 2019

(30) Foreign Application Priority Data

Jan. 31, 2018 (EP) ..... 18154495

(51) Int. Cl.
*A46B 5/00* (2006.01)
*A46B 9/02* (2006.01)
*A46D 3/00* (2006.01)

(52) U.S. Cl.
CPC ..... *A46B 5/0037* (2013.01); *A46B 5/0025* (2013.01); *A46B 5/0033* (2013.01); *A46B 9/023* (2013.01); *A46B 9/025* (2013.01); *A46B 9/026* (2013.01); *A46B 9/028* (2013.01); *A46D 3/005* (2013.01); *A46B 2200/104* (2013.01)

(58) Field of Classification Search
CPC ..... A46B 5/02; A46B 15/003; A46B 17/04; A46D 1/00; A45D 20/48
See application file for complete search history.

(56) References Cited

U.S. PATENT DOCUMENTS 2,238,603 A * 4/1941 Runnels ..... A45D 24/16 132/120
2,438,268 A * 3/1948 Bressler ..... A46B 7/06 15/167.1
2,796,620 A * 6/1957 Bressler ..... A46B 7/06 15/201
3,140,499 A * 7/1964 Du Bois ..... A46B 5/00 15/160

(Continued)

FOREIGN PATENT DOCUMENTS

WO 8501422 4/1985

*Primary Examiner* — Michael D Jennings
(74) *Attorney, Agent, or Firm* — Heslin Rothenberg Farley and Mesiti PC

(57) ABSTRACT

There is disclosed a hair brush. The brush has an elongate body including a utility portion and a handle portion at opposite ends thereof and defining a longitudinal axis. The utility portion includes a back member acting as a support from which brushing protections extend, and defines a first plane and a second plane perpendicularly intersecting the first plane. The back member is flexibly movable with respect to the handle portion on the first plane and the second plane. The utility portion further includes a pair of spines arranged at opposite sides of the back member for controlling the flexible movement of the back member whereby the extent of control of movement of the back member by the spines are either limited to the movement on only the first plane or substantially more on the first plane than the second plane.

13 Claims, 13 Drawing Sheets

(56) References Cited

U.S. PATENT DOCUMENTS

| | | | | |
|---|---|---|---|---|
| 4,475,563 | A * | 10/1984 | Martin | A45D 2/00 132/136 |
| 4,875,792 | A * | 10/1989 | Canada | A46B 11/001 401/283 |
| 5,297,565 | A | 3/1994 | Charitar et al. | |
| 6,505,373 | B2 * | 1/2003 | van Gelder | A46B 5/0025 15/167.1 |
| 7,761,946 | B2 * | 7/2010 | Sorrentino | A61C 17/22 15/22.1 |
| 8,151,397 | B2 * | 4/2012 | Moskovich | A46B 15/0032 15/201 |
| 8,281,448 | B2 * | 10/2012 | Waguespack | A46D 3/00 15/167.1 |
| D815,839 | S * | 4/2018 | Rosenzweig | D4/136 |
| 2004/0025897 | A1 | 2/2004 | Menaged et al. | |
| 2015/0342335 | A1 * | 12/2015 | Nicoline | A46B 5/00 15/160 |

* cited by examiner

HAIR BRUSHES AND METHODS OF MANUFACTURE THEREOF

CROSS REFERENCE TO RELATED APPLICATION

This application claims priority from earlier filed European Patent Application No. 18154495.8 filed Jan. 31, 2018, contents thereof in its entirety are incorporated herein.

FIELD OF THE INVENTION

The present invention is concerned with improved hair brush designs and methods of manufacture of the hair brushes.

BACKGROUND OF THE INVENTION

There is a variety of hair brushes in the market to suit different needs in hair management. One challenge in designing hair brushes is that one hair brush design would not be able address the needs of different users. For example, a hair brush design which would work satisfactorily on a user with relatively dense hair would not produce the same satisfactory styling effect on a user with thinner hair. Likewise, a hair brush design which would work satisfactorily on a user with relatively long hair would not produce the same satisfactory effect on a user with shorter hair. One approach for a hair brush designer to address this issue would be to produce many different hair brush designs to tailor to different user needs. However, this would be technically and commercially undesirable.

The present invention seeks to address the aforementioned issue, or at least to provide an alternative to the general public.

SUMMARY OF THE INVENTION

According to a first aspect of the present invention, there is provided a hair brush comprising an elongate body including a utility portion and a handle portion at opposite ends thereof and defining a longitudinal axis, wherein the utility portion includes a back member acting as a support from which brushing protections extend, and defines a first plane and a second plane perpendicularly intersecting the first plane, wherein the back member is flexibly movable with respect to the handle portion on the first plane and the second plane, wherein the utility portion further includes a pair of spines arranged at opposite sides of the back member for controlling the flexible movement of the back member whereby the extent of control of movement of the back member by the spines are either limited to the movement on only the first plane or substantially more on the first plane than the second plane. With such a hair brush design, the flexibility of the back member on the first plane can be modulated by simply configuring the spines.

Preferably, the back member may have a plurality of repeating units linearly arranged to form a prolongated profile. The plurality of repeating units together may assume a zig-zag formation with the spines controlling longitudinal compression or expansion of the zig-zag formation and sideway flexing of the zig-zag formation on the first plane. The zig-zag formation may have a wider middle portion and narrower end portions along the longitudinal axis.

In one embodiment, the back member and the spines may be integrally formed in one injection molding step and/or formed of one plastic(s) material.

In an alternative embodiment, the back member may be formed from a first injection molding step using a first plastic(s) material and is provided with two sets of channels arranged on the opposite lateral sides of the back member and running along the longitudinal length of the back member, and wherein the pair of spines is formed from a second injection molding step using a second plastic(s) material running through the two sets of channels. The first plastic(s) material may be more rigid than the second plastic(s) material, and wherein the second plastic(s) material may comprise or be an elastomer. The back member may be provided with a plurality of cylindrical openings from which the brushing projections extend, and wherein the cylindrical openings adjacent the two sets of channels are perpendicularly disposed in relation and connected to the channels, and the cylindrical openings adjacent the two sets of channels may be at least partly filled up by the second plastic(s) material. The back member may be covered by a layer made of the second plastic(s) material and resembling a jacket or blanket, the jacket or blanket and the spines may be integrally formed in one injection molding step, and wherein the second plastic(s) material may be an elastomer.

In yet another embodiment, the plurality of repeating units together may assume a spiral formation resembling a compression spring with the spines controlling longitudinal compression or expansion of the spiral formation and sideway flexing of the spiral formation.

In yet another embodiment, the back member includes a plurality of laterally extending ribs arranged parallel to each other, the ribs connected by a backbone extending from a lower portion of the utility portion to a distal end of the utility portion. For example, the repeating units may be formed from a plurality of members each resembling the English letter "T", the T-members are linearly arranged to form the prolongated profile. Alternatively, the repeating units may be formed from a plurality of members each resembling the symbol "π", the π-members are linearly arranged to form the prolongated profile.

Preferably, the utility member may be configured to flex sideway departing from the longitudinal axis thereof, and wherein the degree of flexing ranges from substantially 2° to 30°.

According to a second aspect of the present invention, there is provided a method of manufacture of a brush, comprising the steps of:— a) forming the brush with a utility portion with a flexibly movable back member defining a longitudinal axis and a handle portion at opposite ends thereof, wherein movement of the back member defines a first plane and a second plane perpendicularly intersecting the first plane whereby the back member is flexibly movable with respect to the handle portion on the first plane and the second plane;

b) forming a pair of tensioning spines at on opposite lateral sides of the back member, the spines running longitudinally along the length of the utility portion, whereby the extent of control of movement of the back member by the spines is limited either to the movement on the first plane or substantially more on the first plane than the second plane; wherein said step a) includes forming a plurality of openings from which brushing projections are to be installed thereat.

Preferably, the movement of the back member on the first plane may resemble a sideways movement.

In one embodiment, the handle portion and the spines may be integrally formed in one injection molding step using a single plastics(s) material.

In an alternative embodiment, the back member and the handle portion may be integrally formed in a first injection molding step using a first plastics(s) material, and the spines are formed in a second injection molding step using a second plastics(s) material subsequent the first injection molding step.

Suitably, the method in said step a) may include a step of forming two sets of channels arranged on the opposite lateral sides and running along the longitudinal length of the back member, wherein the openings have a cylindrical profile, and wherein the cylindrical openings adjacent the two sets of channels are perpendicularly disposed in relation and connected to the channels. The second plastic(s) material forming the spines may at least partly fill up the openings adjacent the two sets of channels.

BRIEF DESCRIPTION OF THE DRAWINGS

Some embodiments of the present invention will now be explained, with reference to the accompanied drawings, in which:—

DETAILED DESCRIPTION OF EMBODIMENTS OF THE INVENTION

Figure 1:
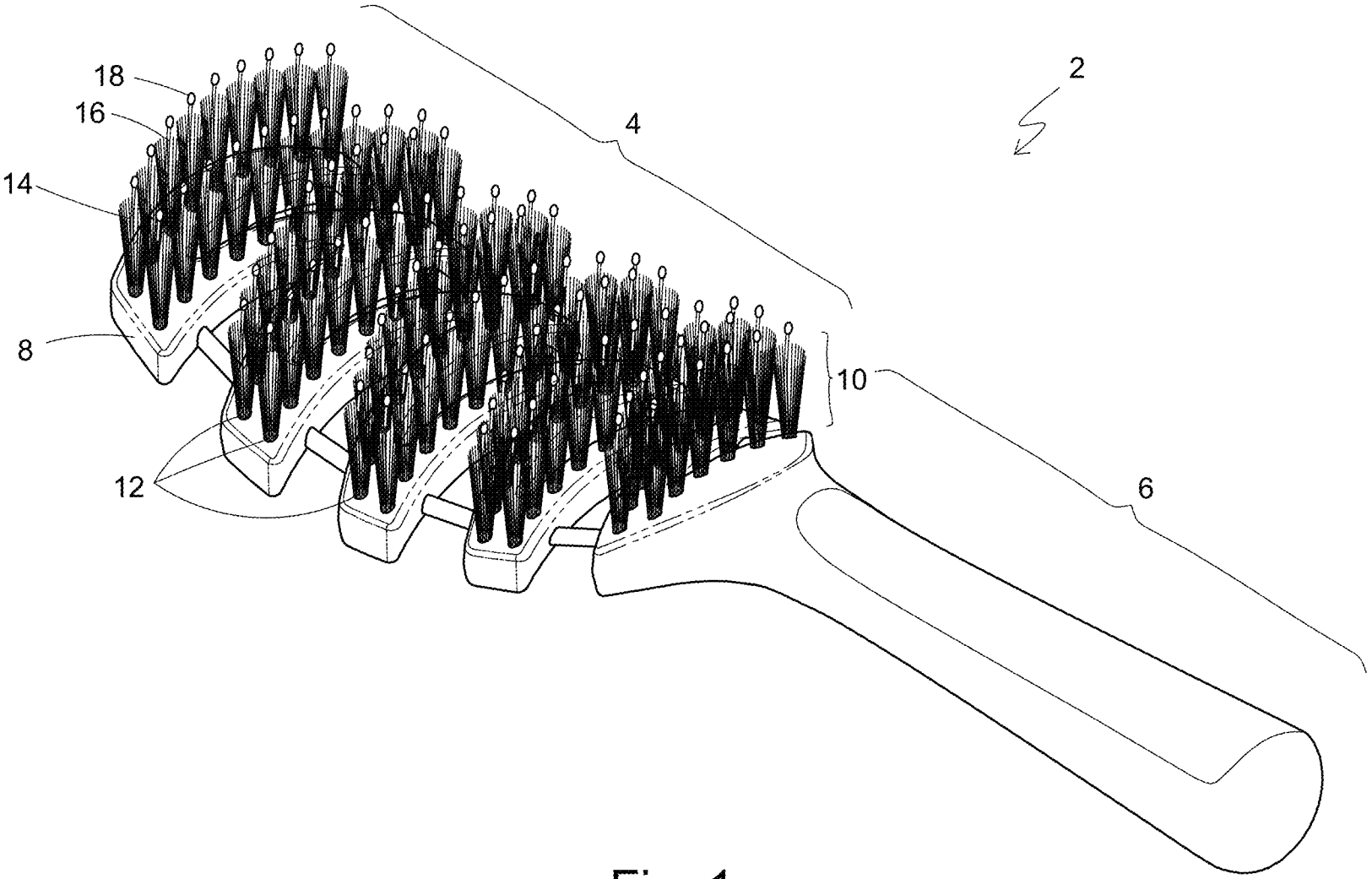
FIG. 1 is a perspective view of a first embodiment of a hair brush according to the present invention.

The present invention is concerned with improved hair brush designs and methods of manufacture thereof, and is illustrated and explained by way of examples below.

FIGS. 1-5B illustrate a first embodiment of a hair brush, generally designated 2. The hair brush 2 has an elongate body including a utility portion 4 located at a front end for engaging the hair of a user during a styling exercise and a handle portion 6 located at a rear end. The handle portion 6 is the form of a stick from which a back member 8 extends. It can be envisaged that the elongate body generally defines a longitudinal axis designated as A-A'. Please see FIGS. 1 and 5B for example. The back member 8 has an elongate body formation 20 providing an outwardly facing surface and an inwardly facing surface. In this embodiment, the body formation 20 assumes a zig-zag configuration. The meaning of "outwardly" and "inwardly" in the context of the present description refers to the relative position of the opposite surfaces of the back member 8. The outwardly facing surface refers to the surface of the back member facing away from the user during use, and the inwardly facing surface refers to the surface of the back member facing towards the user during due. Brushing projections 10 are provided and extend from the inwardly facing surface of the back member. In this embodiment, the brushing projections 10 include a plurality of tufts 12 with each tuft including both brushing filaments 14 which are relatively soft and one plastic(s) bristle 16. Distal end of the bristles 16 are coated with round tips 18 for enhancing contact comfort when the brushing projections 10 engage the hair and the scalp of a user.

FIG. 1 shows that in each of the tuft 12, the bristle 16 is slightly longer than the filaments 14. It is also be noted that the bristles 16 are relatively stiff compared to the filaments 14. It can thus be envisaged that during a hair styling exercise, the bristles 16 typically would tend to engage the hair or the scalp first, followed by the filaments 14. Due to the relatively stiff nature of the bristles 16, they can penetrate deeper into the hair and would reach the scalp to achieve combing while the filaments 14 can achieve brushing of the hair.

Figure 2:
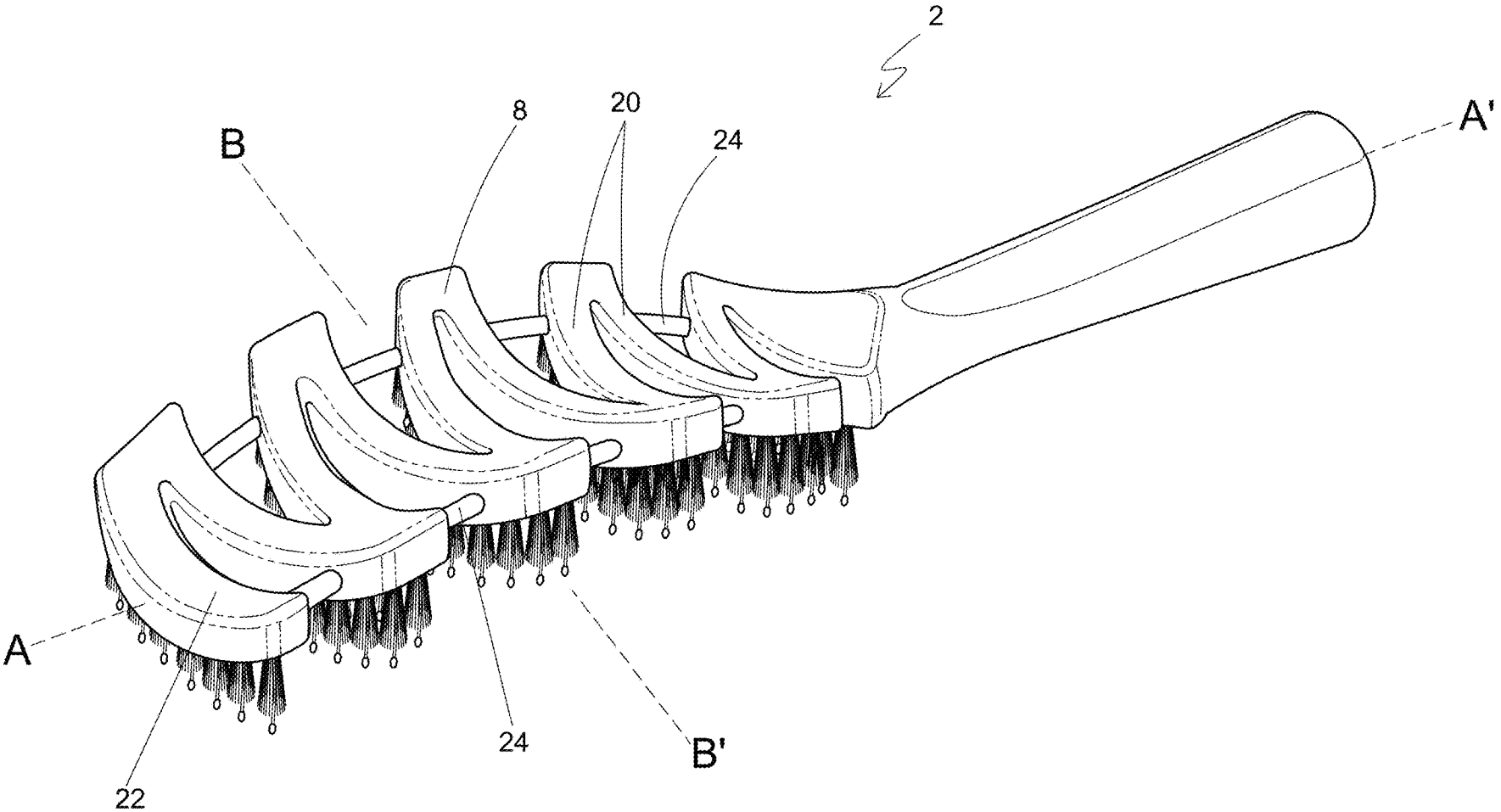
FIG. 2 is an alternative perspective view of the hair brush of FIG. 1.

The zig-zag formation is characterized in that it is generally formed of a relatively thin and continuous lengthened member 22 which extends from a proximal end of the handle portion 6 and in particular generally extends left and right alternately until reaching the upper end of the back member 8. Please see FIG. 2. By "relatively thin", it means the thickness, width or girth is, for example, smaller than that of the handle portion 6. When considering the zig-zag formation 20 alone, it can thus be envisaged that this particularly formation would introduce resilience to the back member 8, resembling a spring. For example, the zig-zig formation 20 can allow the back member 8 to compress or expand along longitudinal axis A-A' as indicated in FIG. 2 or 5B. In addition, at least a distal end of the zig-zag formation 20 can flex sideway and depart from the longitudinal axis A-A'. Please see flexing movement indicated by B-B' in FIG. 2. The exact extent that the zig-zag formation 20 can compress or expand along the longitudinal axis A-A' depends on a number of factors including, for example, the length of the continuous member of the zig-zag formation 20. If the continuous member 22 is relatively long, the extent by which the zig-zag formation 20 can compress or expand would be greater. If the continuous member 22 is made of a relatively soft material, the extent of compression and expansion would be larger.

The hair brush 2 is further provided with a tensioning means. In this embodiment, the tensioning means includes a pair of spines 24 which are disposed at opposite lateral sides of the back member 8. The spines 24 extend from a lower end to an upper end of the zig-zag formation 20 of the back member 8, or from a "hip" region to the upper end of the brush 2. Due to the presence of the spines 24 on the opposite lateral sides, the extent of compression or expansion along the longitudinal axis A-A' is restricted. It can thus be understood that the provision of the tensioning means to the back member can further modulate the longitudinal movement of the back member 8. By way of the tensioning means, the extent of sideway flexing B-B' can also be controlled. It is to be noted that the spines 24 are different from the back member 8 in a number of ways. For example, the spines 24 are located on lateral sides of the back member. The spines are substantially thinner comparted to the body formation 20. Further, the role of the body formation 20 is primarily on the provision of rigidity while the spines 24 are primarily on the provision of control on the sideway flexibility. In this embodiment, the zig-zag configuration of the body formation 20 primarily controls the compressibility/expandability of the back member.

Figure 3:
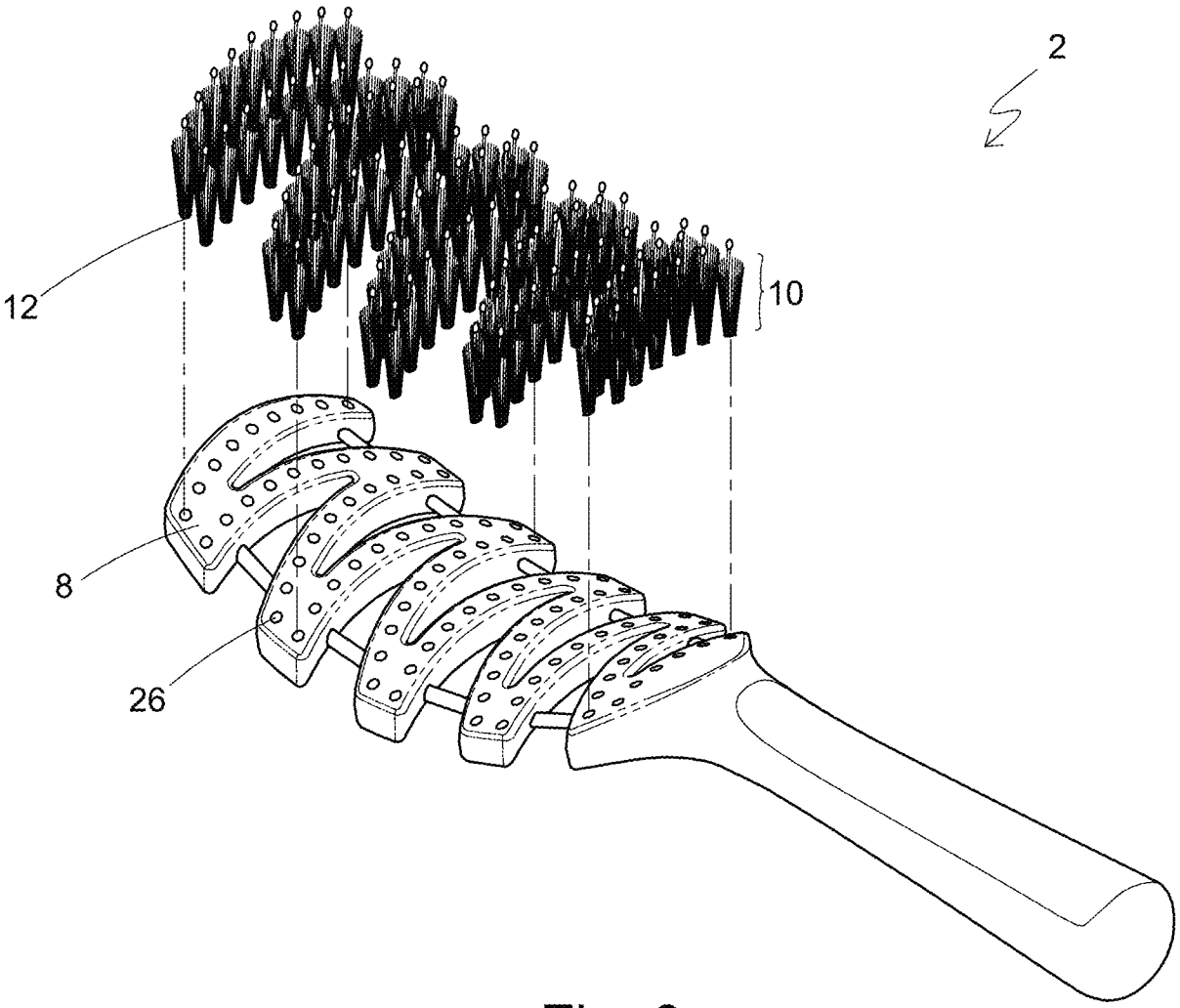
FIG. 3 is an exploded view of the hair brush of FIG. 1.

FIG. 3 is an exploded view of the hair brush 2. It is shown that the inwardly facing surface of the back member 8 is provided with a plurality of openings 26 at which the brushing protections 10 are installed. In this embodiment, the openings 26 are lined up in a row along a path defined by the zig-zag formation 20. Specifically, in this embodiment, there is provided with one single row of these openings.

Figure 4A:
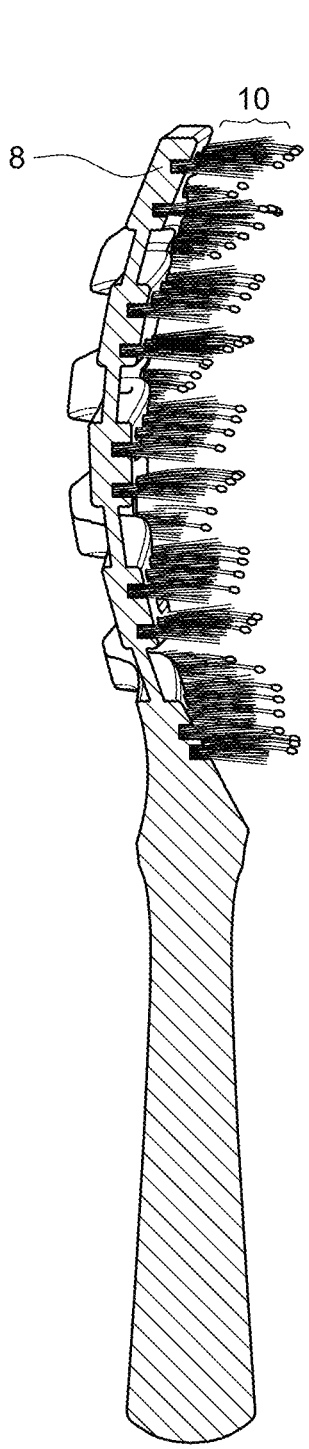
FIG. 4A is a cross view of the hair brush of FIG. 4B taken at C-C'.
Figure 4B:
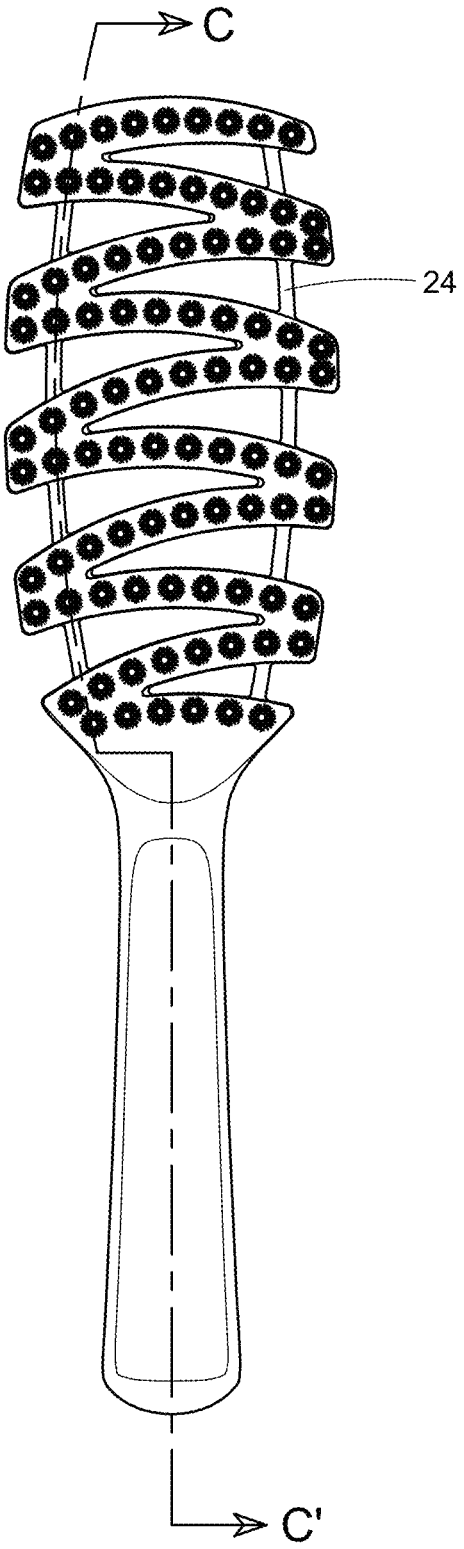
FIG. 4B is a plan view of the hair brush of FIG. 1.

FIG. 4B is a plan view showing the hair brush 8 at the side with brushing projections 10. FIG. 4A is a cross section view taken at section C-C'. From FIG. 4A, it is to be understood that the back member 8 together with the spines are integrally formed. For sake of clarity, the meaning of "integrally formed" in the context of this invention is specific and refers to the back member 8 and the spines 24 formed in one injection molding step with one injection molding material. Despite the zig-zag member 20 and the spines 24 both formed from one plastic(s) material, due the thicker or wider profile of the zig-zag member, it is stiffer than the spines 24.

Figure 5A:
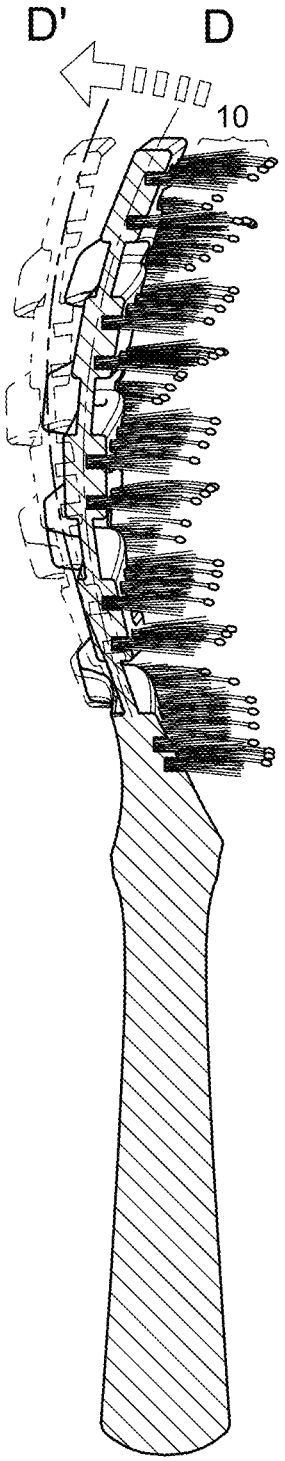
FIGS. 5A and 5B are schematic diagrams showing possible flexing motions of the hair brush of FIG. 1 during use by a user.
Figure 5B:
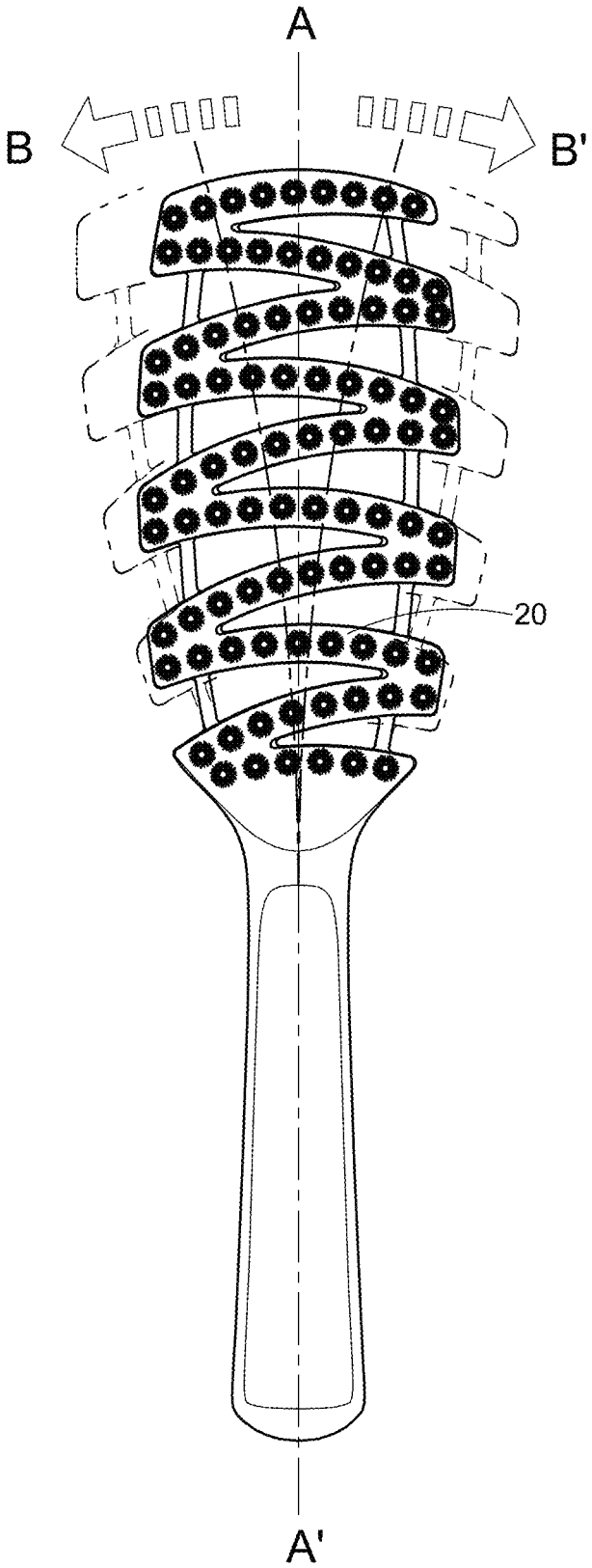

FIGS. 5A and 5B are schematic views showing the hair brush 2 being used in a hair styling exercise. In addition to the longitudinal expansion/compression of the back member 8 along axis A-A' and the sideway flexing (movement B-B', please see FIG. 5B), the hair brush 2 is also configured, when engaged, to flex backward away from the user, as indicated by movement D-D' in FIG. 5A. Thus, the hair brush 2 is configured with the back member 8 movable three-dimensionally, particularly with the movement A-A' and the movement B-B' modulated depending the physical characteristics of the spines 24. The side-way flexing movement B-B' is performed on one plane. The backward-forward forward movement of D-D' is performed on a second, and different, plane. The two planes intersect with each other perpendicularly. Due the presence of the spines 24 on opposite lateral sides of the back member, the sideway flexing movement B-B' is modulated, while the backward-forward flexing movement is not. It can thus be envisaged that even with one single hair brush design of the present invention, for example, the use of different thickness for the spines can generate different hair brushes with back members with different expandability/compressibility and sideway flexibility. Thus, the different hair brushes according to the present invention although sharing the same hair brush design can thus suit the needs of different users, including users with denser hair and users within thinner hair. Accordingly, there would not need the provision of entirely different hair brush designs to address different user needs in this regard.

As explained, the hair brush 2 includes the tensioning means in the form of a pair of spines 24. In one embodiment, as described above, the back member 8 including the zig-zag formation 20 and the spines 24 are integrally formed from one plastic(s) material in one molding step as a first step. Then brushing projections 10 are installed to the back member 8 as a second step. From a design level, a designer can use this same design to generate different hair brushes by modulating the configuration of the spines 24. For example, a series of hair brushes from relatively less compressible back member to relatively expandable back member can be made by merely adjusting the stiffness or thickness of the spines, and not other portions of the back member 8. Users can thus choose the suitable hair brushes with suitable springiness.

Figure 6:
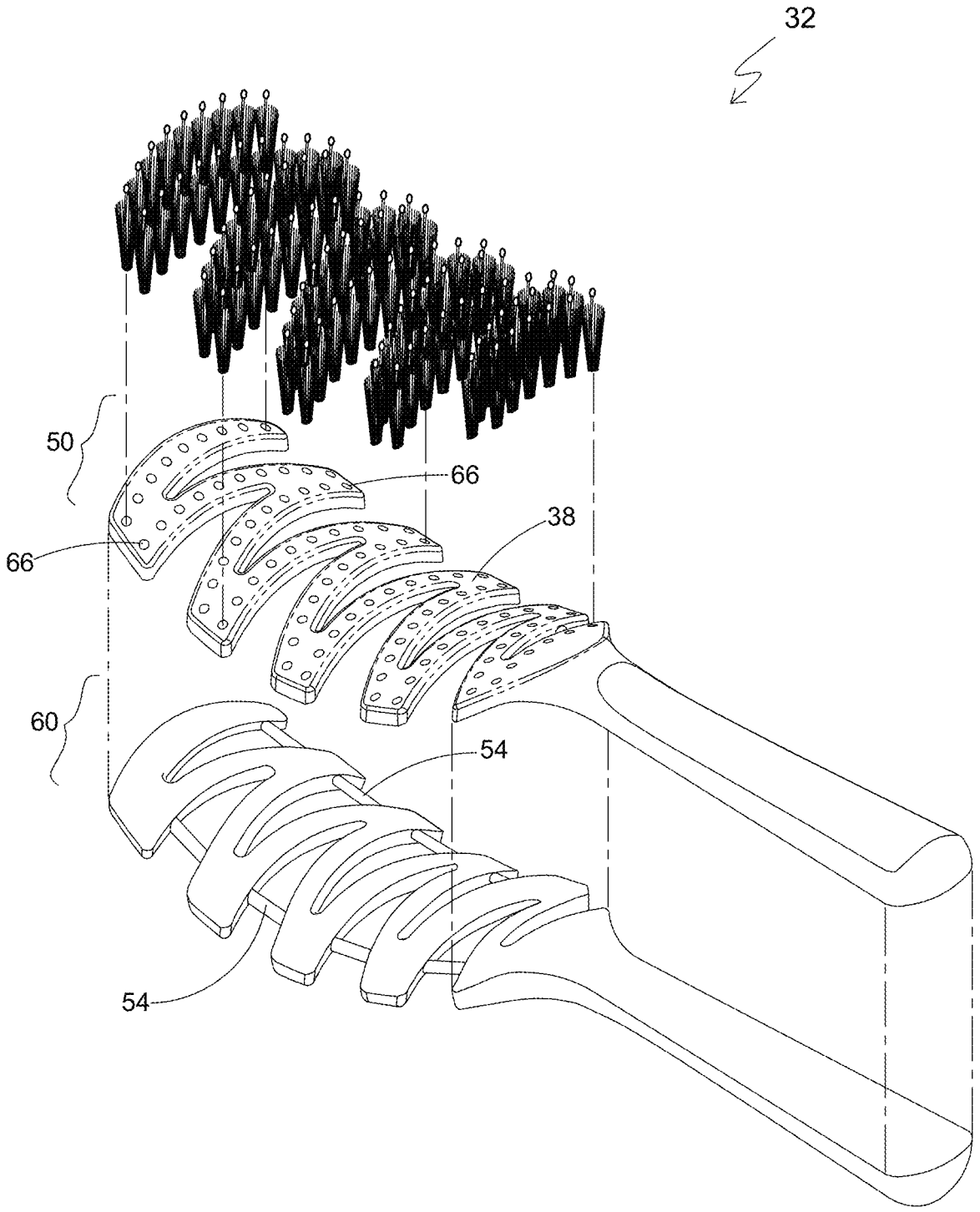
FIG. 6 is an exploded view of a second embodiment of a hair brush according to the present invention.
Figure 7A:
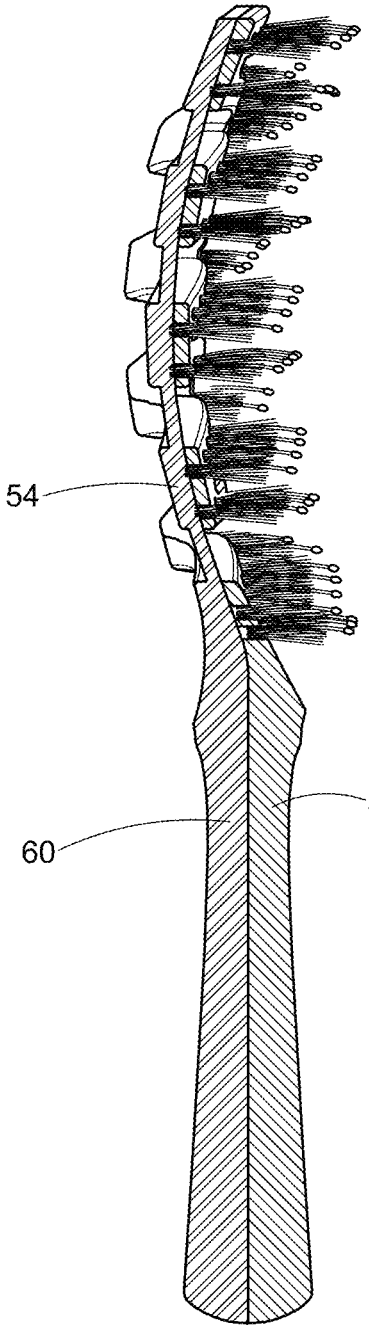
FIG. 7A is a cross view of the hair brush of FIG. 7B taken at D-D'.
Figure 7B:
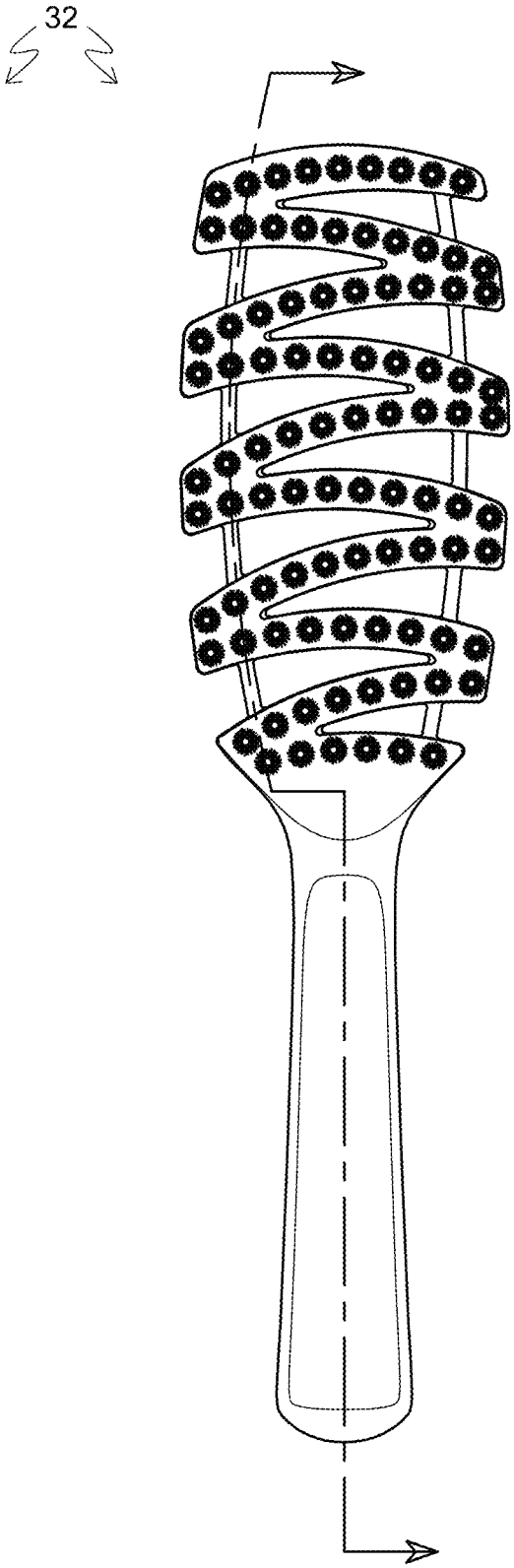
FIG. 7B is a plan view of the hair brush of FIG. 6.
Figure 8A:
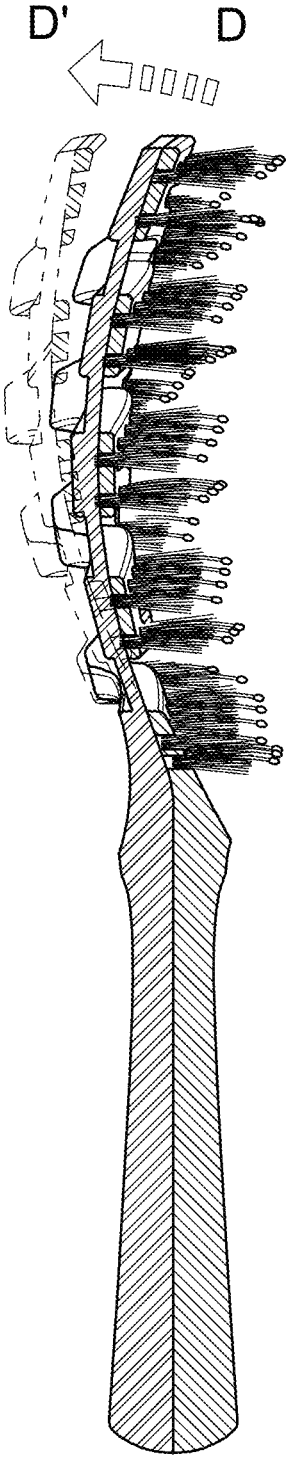
FIGS. 8A and 8B are schematic diagrams showing possible flexing motions of the hair brush of FIG. 6 during use by a user.
Figure 8B:
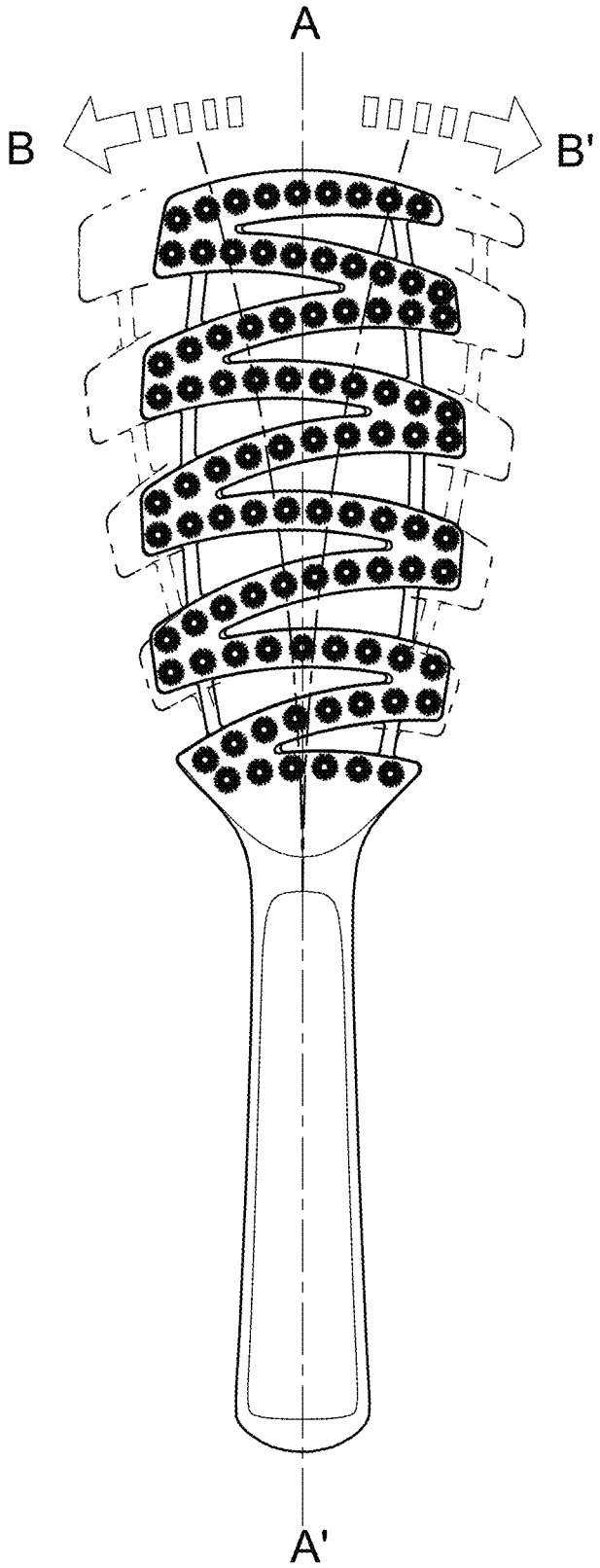

FIGS. 6 to 8B illustrate a different embodiment of a hair brush 32 according to the present invention. Similar to the hair brush 2, the hair brush 32 likewise includes a back member 38 with outwardly and inwardly facing surfaces arranged on opposite sides of the brush 32. For brevity purpose, similarities of the brushes 2, 32 are not repeated there. The brush 32 is however different in a number ways. Referring to FIG. 6, it is to be noted that one difference is that a zig-zag member 50 and a tensioning means of the back member 38 are not formed integrally, i.e. not in one step from one plastic(s) material. Instead, they are formed in two separates steps from two different plastic(s) or polymeric materials. The back member 38 including the continuous zig-zag member 50 is firstly formed from a first injection molding step from a stiffer plastic(s) material. In this first step, the tensioning means or spines are not formed yet. Then after the first step, the tensioning means are subsequently formed as a second step. Specifically, a layer of softer plastic(s) material 60, e.g. elastomer, including the spines, is injection-molded to an outwardly facing surface of the hair brush 32 in a subsequent single step. The elastomer layer 60 resembles a jacket which cover the outwardly facing surface. During the second injection molding step, the spines 54 are also formed. Please see and compare FIGS. 7A and 7B in which the jacket-and-spine member is formed subsequently in a different material after the formation of the formation 50. Please see cross section view FIG. 7A in particular.

In this embodiment, the back member 38 formed is provided with recesses in the form of cylindrical openings 62 at the inwardly facing surface from which brushing projections 64 are installed. The back member 38 is provided with further openings 66 (not shown) defining through-channels vertically extending along lateral sides of the zig-zag member 50. The through-channels and the cylindrical openings 62 for the brushing projections adjacent the channels are fluid communicable. The cylindrical openings 62 adjacent the two sets of through-channels are perpendicularly disposed in relation and connected to the channels, and during formation of the jacket the openings of the through-channels are filled with, for example, elastomers and the cylindrical openings adjacent the two sets of through-channels are at least partly filled up. It can be envisaged that the spines are gripped at the channels and to some extent the recesses.

Due to difference of materials of the back member and the jacket/spines, this embodiment allows a greater flexibility in terms of control of springiness of the back member. For example, when a softer elastomer is used as the spines, the hair brush formed would have a greater flexibility, i.e. expandability and compressibility.

Figure 9:
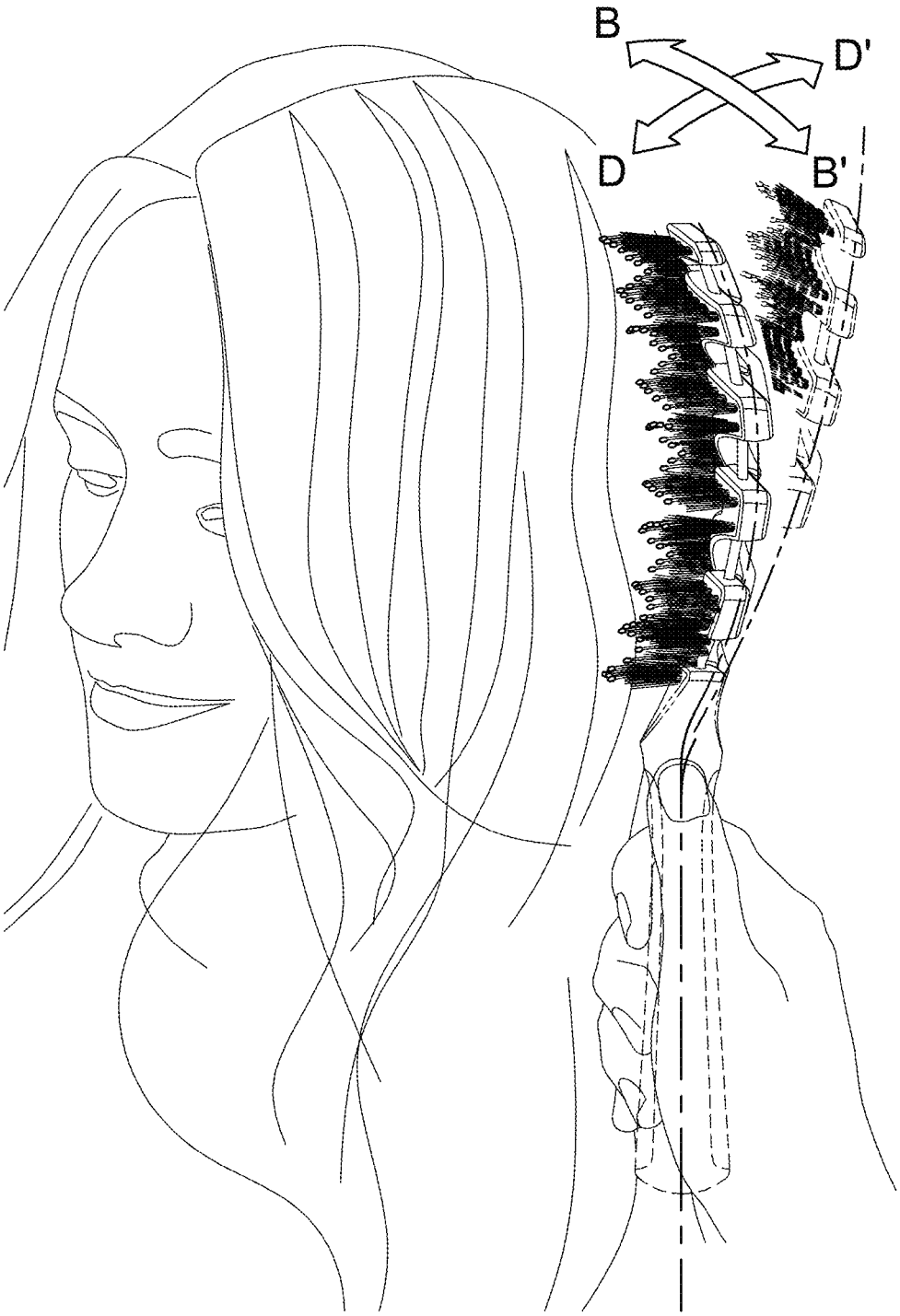
FIG. 9 is a schematic diagram showing possible flexing motions of the hair brush of FIG. 1 or FIG. 6 during use by a user.

FIG. 9 is a schematic diagram showing the working of the brush (2 or 32). It is shown that the brush can flex sideway B-B' on one plane, and backward-forward D-D' on another plane. As explained above, the extent of control of sideway flexing B'B' is determined by the spines, while that of backward-forward D-D' is not. Despite the slight difference in construction of the brushes 2, 32, both designs share the characteristic of being able modulate the extent of control of sideway flexing only by way of the physical characteristics of the pair of spines, and not that of backward-forward flexing. In a preferred embodiment, the extent of sideway flexing of the back member is limited to 2° to 30°, the exact extent is determined by the tensioning means.

Figure 10A:
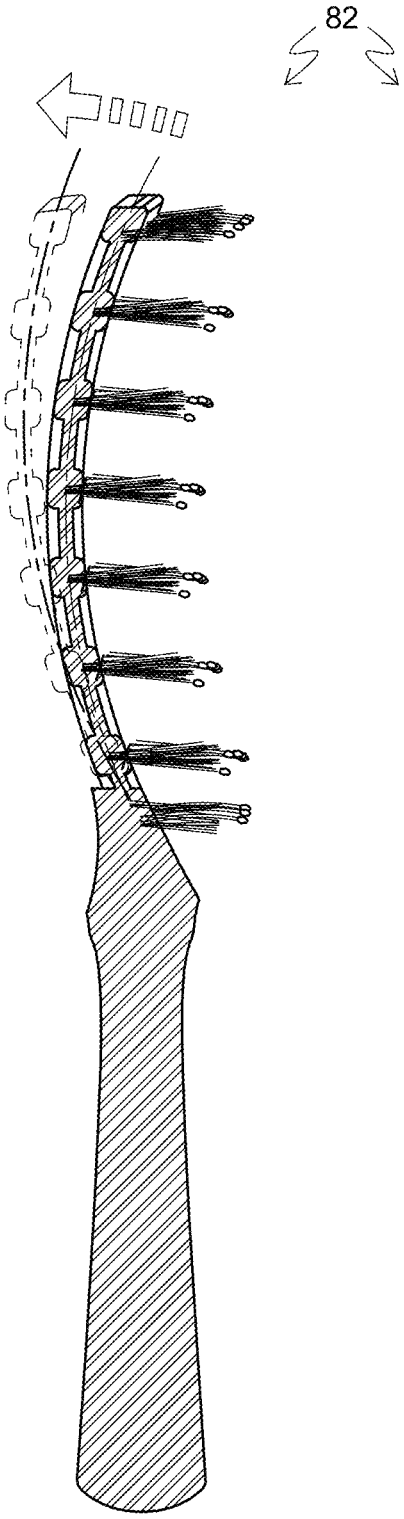
FIGS. 10A and 10B are schematic diagrams showing possible flexing motions of a third embodiment of a hair brush according to the present invention.
Figure 10B:
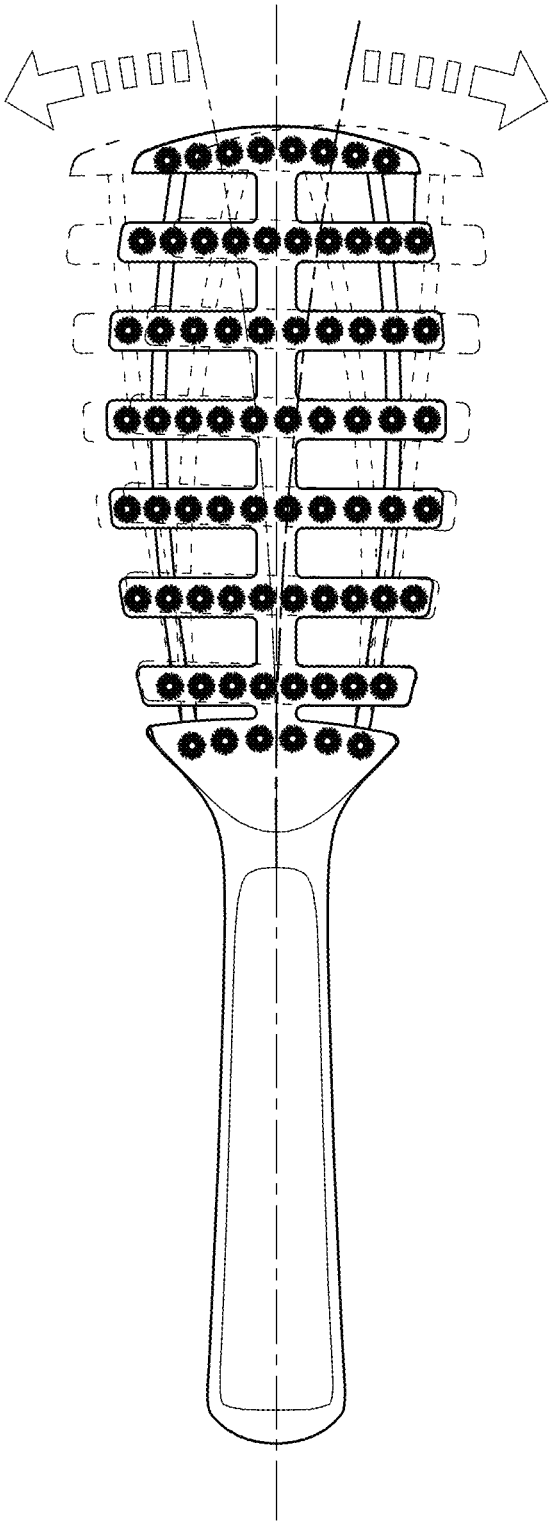

FIGS. 10A and 10B are a plan view and a cross section view of a different embodiment of a hair brush according to the present invention. In this embodiment, instead of using a back member with a zig-zag formation, a different back member with a single backbone positioned in the center of the back member with laterally extending parallel ribs. In any event, both the brushes 2, 32 and the brush 82 share a number of characteristics. First, the back member is formed from a plurality of repeating units which together are configured to a continuous protonated profile. With regard to the brushes 2, 32, each repeating unit resembles the symbol "<" which when arranged together take the form of the zig-zag formation. With regard to the brush 82, each repeating unit resembles the English letter "T" which when arranged together take the form of the back member of the brush 82. Please see FIG. 10B in particular. Similarly, the extent of control of the sideway flexing of the back member of the brush 82 is determined by the spines.

Figures 11A, 11B:
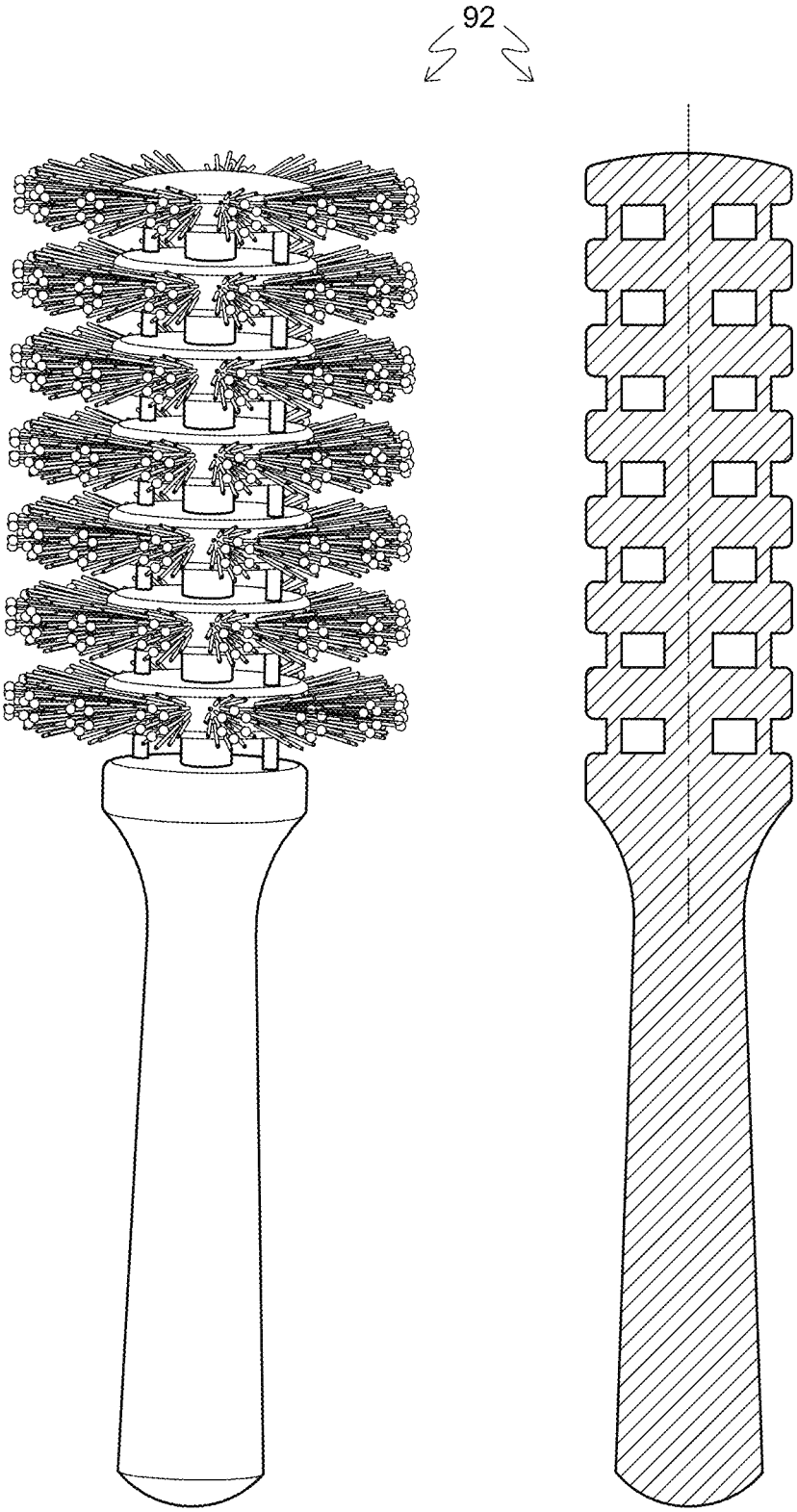
FIG. 11A is a perspective view of a fourth embodiment of a hair brush according to the present invention.
FIG. 11B is a cross section view of the hair brush of FIG. 11A, but with brushing projections thereof removed.
Figure 12A:
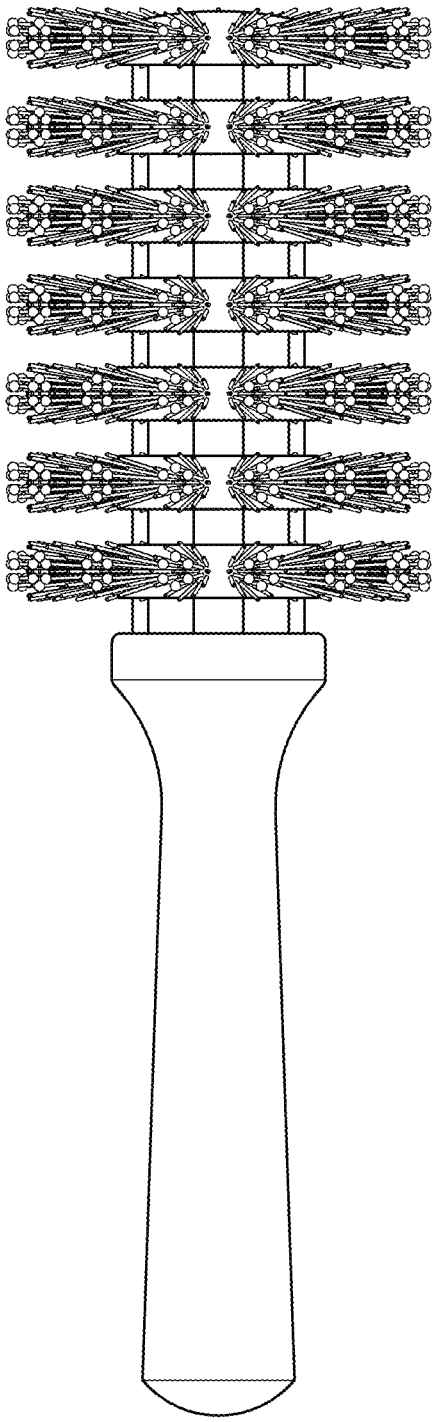
FIGS. 12A and 12B are schematic diagrams showing possible flexing motions of the hair brush of FIG. 11A.
Figure 12B:
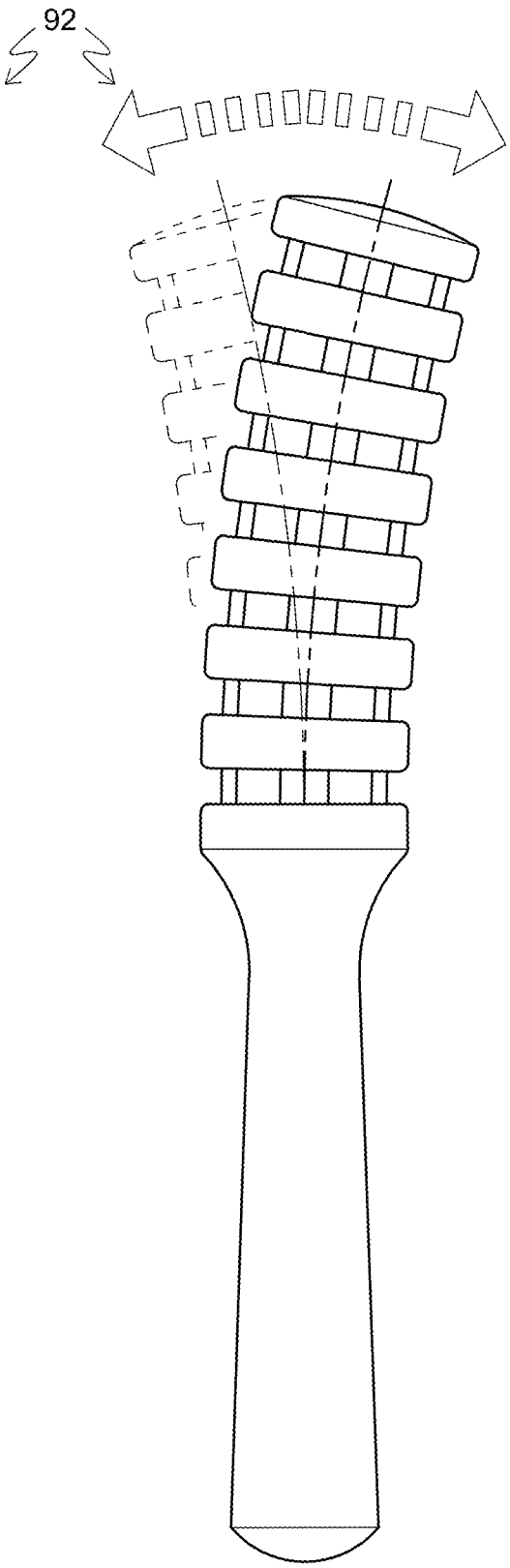

FIGS. 11A and 11B are a perspective view and a simplified cross section view of an alternative embodiment of a brush 92 according to the present invention. The brush 92 is similar to the brush 82 in that the back member is provided with a backbone extending along a longitudinal axis of the brush. There are however a number of differences. For example, the utility portion of the brush 92 generally takes the form of a roller. The back member is made of a backbone with a plurality level of discs arranged parallel with each other along the backbone. Brushing projections extend from the entire circumferential surface of the back member. Nevertheless, there is still provide the tensioning means in the form of a pair of spines arranged on opposite lateral sides of the utility portion. The brush 92 still shares the characteristics of the back member formed from a plurality of repeating units which together are configured to a continuous protonated profile. Specifically, with regard to the brush 92, each repeating unit is made of a post with a disc, which when arranged together take the form of a prolongated structure. Similarly, the extent of control of the sideway flexing of the back member (but not backward-forward flexing) of the brush 92 is determined by the spines. Please see FIG. 12B which demonstrates the sideway flexing of the utility portion.

Figure 13A:
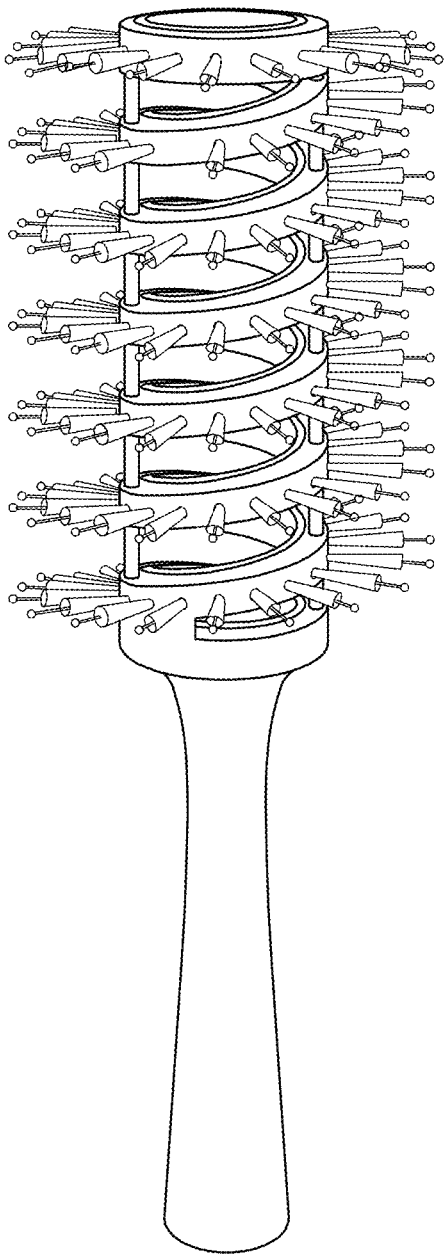
FIG. 13A is a perspective view of a fifth embodiment of a hair brush according to the present invention.
Figure 13B:
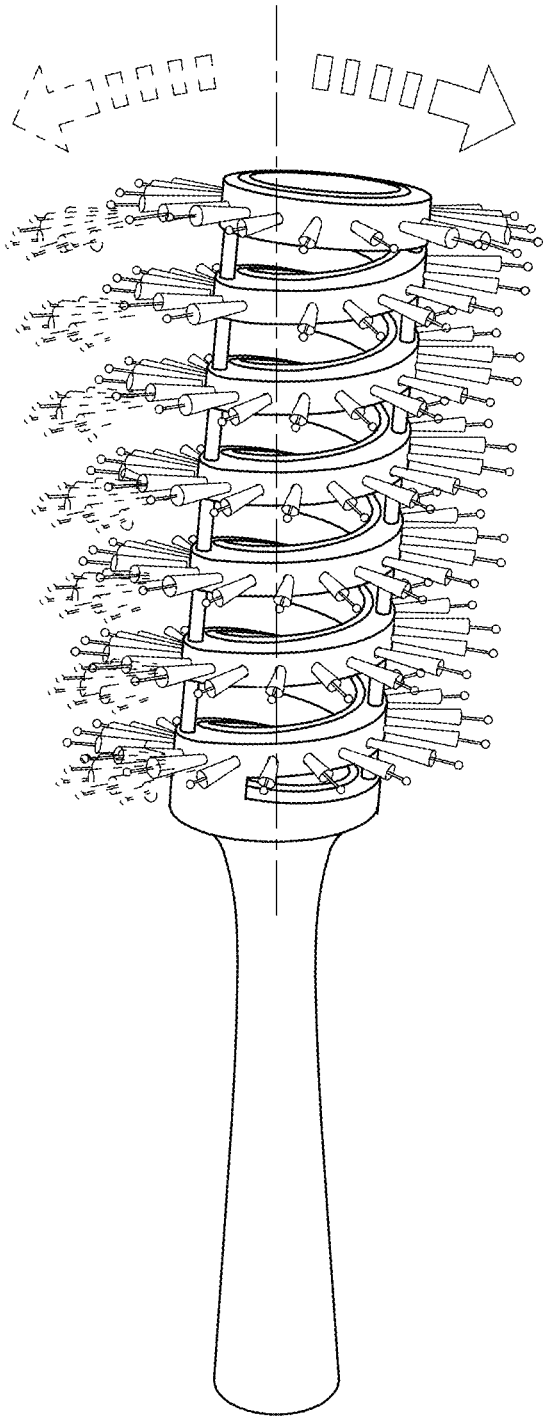
FIG. 13B is a schematic view showing effect of spines on the control of extent of a flexing motion by the hair brush of FIG. 13A.

FIGS. 13A and 13B are perspective views of an alternative embodiment of a brush 102 according to the present invention. The brush 102 is similar to the brushes 2, 32, 82, 92 in that the back member is provided with a back member from which brushing projections extending. One difference is that the back member is in the form of zig-zag formation or a plurality of connected English letter "T"s continuously. Instead, the back member takes the form of a spiral formation. Nevertheless, there is still provided with the tensioning means in the form of a pair of spines arranged on opposite lateral sides of the utility portion. The brush 102 still shares the characteristics of the back member formed from a plurality of repeating units which together are configured to a continuous protonated profile. Similarly, the extent of control of the sideway flexing of the back member (but not backward-forward flexing) of the brush 102 is determined by the spines. Please see FIG. 13B which demonstrates the sideway flexing of the utility portion.

It should be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. It is to be noted that certain features of the embodiments are illustrated by way of non-limiting examples. For example, the back member may take the form of a zig-zag formation, a formation with plurality of repeating units of connected T-structures, a spiral formation, etc. Other configurations of the back member are possible as long it has a structure of repeating units or least with tensioning means to control sideway flexing. For example, a formation with a plurality of repeating units resembling "π" members connected together is also workable. Also, a skilled person in the art will be aware of the prior art which is not explained in the above for brevity purpose.

The invention claimed is:

1. A hair brush comprising an elongate body including a utility portion and a handle portion at opposite ends thereof and defining a longitudinal axis, wherein the utility portion includes a continuous and resilient back member acting as a support from which brushing protections extend, and defines a first plane and a second plane perpendicularly intersecting the first plane, wherein the back member is flexibly movable with respect to the handle portion on the first plane as well as on the second plane, characterized that:

the utility portion includes a pair of tensioning spines arranged at opposite sides of the back member for further controlling the flexible movement of the back member; and due to the tensioning spines, the utility member is configured to flex sideway departing from the longitudinal axis thereof, and the degree of flexing ranges from substantially 2° to 30° , whereby the extent of control of movement of the back member by the spines are either limited to the movement on only the first plane or more on the first plane than the second plane; and wherein i) the back member and the spines are integrally formed in one injection molding step or formed of one plastic(s) material or ii) the back member is formed from a first injection molding step using a first plastic (s) material and is provided with two sets of channels arranged on the opposite lateral sides of the back member and running along the longitudinal length of the back member, and the pair of spines is formed from a second injection molding step using a second plastic (s) material running through the two sets of channels.

2. A brush as claimed in claim 1, wherein the back member has a plurality of repeating units linearly arranged to form a prolongated profile.

3. A brush as claimed in claim 2, wherein the plurality of repeating units together assumes a zig-zag formation with the spines controlling longitudinal compression or expansion of the zig-zag formation and sideway flexing of the zig-zag formation on the first plane.

4. A brush as claimed in claim 3, wherein the zig-zag formation has a wider middle portion and narrower end portions along the longitudinal axis.

5. A brush as claimed in claim 2, wherein the plurality of repeating units together assumes a spiral formation resembling a compression spring with the spines controlling longitudinal compression or expansion of the spiral formation and sideway flexing of the spiral formation.

6. A brush as claimed in claim 2, wherein the back member includes a plurality of laterally extending ribs arranged parallel to each other, the ribs connected by a backbone extending from a lower portion of the utility portion to a distal end of the utility portion.

7. A brush as claimed in claim 2, wherein the repeating units are formed from a plurality of members each resembling the English letter "T", the T-members are linearly arranged to form the prolongated profile.

8. A brush as claimed in claim 2, wherein the repeating units are formed from a plurality of members each resembling the symbol "π", the π-members are linearly arranged to form the prolongated profile.

9. A brush as claimed in claim 1, wherein when the back member is formed from the first injection molding step using the first plastic(s) material and the pair of spines is formed from the second injection molding step using the second and different plastic(s) material running through the two sets of channels, the first plastic(s) material is more rigid than the second plastic(s) material, and the second plastic(s) material comprises or is an elastomer.

10. A brush as claimed in claim 9, wherein the back member is provided with a plurality of cylindrical openings from which the brushing projections extend, and wherein the cylindrical openings adjacent the two sets of channels are perpendicularly disposed in relation and connected to the channels, and the cylindrical openings adjacent the two sets of channels are at least partly filled up by the second plastic(s) material.

11. A brush as claimed in claim 9, wherein the back member is covered by a layer made of the second plastic(s) material and resembling a jacket or blanket, the jacket or blanket and the spines are integrally formed in one injection molding step, and wherein the second plastic(s) material is an elastomer.

12. A method of manufacture of a brush made from essentially one or more polymeric materials, characterized in that:— a) forming the brush with a utility portion with a continuous and resilient back member defining a longitudinal axis and a handle portion at opposite ends thereof, wherein movement of the back member defines a first plane and a second plane perpendicularly intersecting the first plane whereby the back member is flexibly movable with respect to the handle portion on the first plane as well as on the second plane;

b) forming, additionally a pair of tensioning spines at on opposite lateral sides of the back member, the spines running longitudinally along the length of the utility portion;

wherein:

said step a) includes forming a plurality of openings in the back member from which brushing projections are to be installed thereat; and the utility member is configured to flex sideway departing from the longitudinal axis thereof, and wherein the degree of flexing ranges from substantially 2° to 30° whereby the extent of control of movement of the back member by the spines is limited either to the movement on the first plane or more on the first plane than the second plane.

13. A method of manufacture of a brush made of essentially one or more polymeric materials, characterized in:

a) forming the brush with a utility portion with a continuous and resilient back member defining a longitudinal axis and a handle portion at opposite ends thereof, wherein movement of the back member defines a first plane and a second plane perpendicularly intersecting the first plane whereby the back member is flexibly movable with respect to the handle portion on the first plane as well as on the second plane;

b) forming, additionally a pair of tensioning spines at on opposite lateral sides of the back member, the spines running longitudinally along the length of the utility portion;

wherein:

the method comprises the forming of both the continuous and resilient back member as well as the tensioning spines, wherein, in addition to the back member, the tensioning spines further controls extent of movement of the back member.

* * * * *